US005872891A

United States Patent [19]

Son

[11] Patent Number: 5,872,891

[45] Date of Patent: Feb. 16, 1999

[54] SYSTEM FOR PROVIDING SUBSTANTIALLY INSTANTANEOUS HOT WATER

[76] Inventor: Jae S. Son, 605 Sheldon St., El Segundo, Calif. 90245

[21] Appl. No.: 653,004

[22] Filed: May 24, 1996

[51] Int. Cl.[6] ..... F24H 1/00

[52] U.S. Cl. ..... 392/492; 137/341; 126/344

[58] Field of Search ..... 392/490–492, 392/485, 479, 473–474, 449, 451, 454; 126/344, 361, 362; 4/598; 165/DIG. 109, DIG. 120, 297, 298; 137/341

[56] References Cited

U.S. PATENT DOCUMENTS

| | | | |
|---|---|---|---|
| 1,850,156 | 3/1932 | Richardson | 392/492 |
| 2,775,683 | 12/1956 | Kleist | 392/492 |
| 3,091,393 | 5/1963 | Sparrow | 4/598 |
| 3,434,660 | 3/1969 | Brumme et al. . | |
| 3,569,668 | 3/1971 | Carlisle . | |
| 3,569,669 | 3/1971 | March . | |
| 4,433,810 | 2/1984 | Gottlieb . | |
| 4,551,612 | 11/1985 | Sprague . | |
| 4,680,446 | 7/1987 | Post | 392/451 |
| 4,687,905 | 8/1987 | Cunningham et al. . | |
| 4,713,525 | 12/1987 | Eastep | 392/465 |
| 5,159,659 | 10/1992 | Cameron . | |
| 5,170,462 | 12/1992 | Park . | |
| 5,247,908 | 9/1993 | Williamson | 392/451 |
| 5,251,282 | 10/1993 | Hanning et al. . | |
| 5,278,941 | 1/1994 | Ward . | |
| 5,293,446 | 3/1994 | Owens et al. . | |
| 5,293,583 | 3/1994 | Chudgar . | |
| 5,305,418 | 4/1994 | Tuttle . | |
| 5,305,419 | 4/1994 | Cameron . | |
| 5,317,670 | 5/1994 | Elia . | |

FOREIGN PATENT DOCUMENTS

| | | | |
|---|---|---|---|
| 2200733 | 8/1988 | United Kingdom | 392/485 |

*Primary Examiner*—John A. Jeffery
*Attorney, Agent, or Firm*—Wolf, Greenfield & Sacks, P.C.

[57] ABSTRACT

A water heater tank is designed to be installed within a wall to provide substantially instantaneous and continuous hot water when the faucet is activated. The tank maintains water at a hot temperature to be mixed, if necessary, with standing water from the main hot water line. The tank includes a narrow channel through which the water traverses as it proceeds through the tank. A controller calculates the appropriate mixing ratio of the water sources depending on the desired water temperature.

5 Claims, 6 Drawing Sheets

SYSTEM FOR PROVIDING SUBSTANTIALLY INSTANTANEOUS HOT WATER

BACKGROUND

1. Field of the Invention

This invention relates to providing hot water to the end user, in particular, for providing hot water substantially instantaneously to the user upon activation of the faucet.

2. Background of the Invention

In a typical household or apartment setting, obtaining hot water from a faucet requires the user to wait for a period of time, sometimes as long as several minutes, after turning on the faucet. This delay is primarily because the heating tank is usually located in the basement of the building or somewhere far from the faucet being used. Remote placement of the heating tank is common in North America and other regions where the space near the faucet, such as in kitchens and bathrooms, is limited. When the faucet is not turned on, the water in the piping between the hot water source and faucet loses its heat to the surroundings. Due to the substantial amount of piping in some homes and the corresponding exposed surface area of the water contained therein, after a minimal amount of time, the water drops to room temperature. As a result, all of this standing water must be flushed out before hot water from the water heater reaches the faucet. In addition, while waiting for the standing water in the pipes to exit the faucet, users generally continue to adjust the hot and cold dials, often overcompensating the percentage of hot or cold water, until the desired temperature is reached. The desired temperature, however, is only consistently maintained after all the standing water in the hot water pipes has been flushed out.

One of the simplest and cheapest solutions to mitigate this problem is to place the water heater closer to the faucet. An obvious drawback is that the limited space in bathrooms and kitchens cannot comfortably or aesthetically accommodate a 30 or 40 gallon water heater. In addition, multiple tanks throughout the house is not energy efficient.

Point-of-use heaters, which are currently available, heat water only as needed. They are generally smaller than conventional water tanks so they can be located in the same room as the faucet, although they cannot be readily concealed behind a wall. Moreover, point-of-use gas heaters require additional lines for the gas, a ventilation system for air intake, and an exhaust for combustion. Industrial point-of-use heaters, on the other hand, require substantial electrical power which is typically too much for the home. Electrically powered point-of-use heaters designed for residential use only raise the water temperature to take the "chill out." They are more common in warmer climates where the heating requirements are less.

Finally, hot water can be recirculated to keep the water in the hot water pipes hot. This type of system is mostly used for hotels and large buildings, and the cost of implementing such a system for a residential home is prohibitively expensive.

One company, In-Sink-Erator™, sells a system for providing water at 190° F. instantly for making hot drinks. The system essentially comprises a separate faucet attached to a small heated reservoir under the sink. This device, called Steamin' Hot™, provides water at a temperature normally not obtainable through conventional water heaters because many states regulate the maximum water heater temperature setting to prevent scalding. This product, however, does not address the present problem of the time delay and temperature fluctuation associated with faucets and showers.

Merloni Termo Sanitari Company manufactures a product called Ariston™ which is a small water heater with a 2.4 or 4 gallon capacity. Although much smaller than a conventional water heater, it requires bulky insulation and is not designed to fit inside the walls of a house. More importantly, it does not keep the hot water inside the tank separate from the incoming cool water. This is essential for smaller tanks to provide uninterrupted hot water until the hot water from the hot water pipe arrives.

Currently, there are patents and devices on the market regulating water temperature through the use of servo controlled valves. Home use applications, however, have been limited primarily because of the high cost of the devices. Recently, Hass Mfg.™ and American Standard™ have offered temperature regulating control systems called Intelli Faucet™ and Ultra Valve™, respectively. All of these temperature regulation means require a hot and a cold water supply source. Because these devices do not heat the water, they cannot provide the desired water temperature if the water in the hot water pipe is cooler than the desired water temperature. Thus, these temperature controllers cannot avoid the delay caused while flushing standing water from the hot water pipes.

Sprague, U.S. Pat. No. 4,551,612, describes a water heating tank that can be installed inside a wall as a replacement for conventional water heating tanks. The patent describes a method for conserving space required by conventional water heaters. However, the Sprague water heater, having a thin profile, becomes larger and the surface area to volume ratio increases resulting in extraneous energy waste. In addition, the structural strength of the water tank must be made stronger to support the water if one were to use the Sprague device to replace a conventional tank.

SUMMARY OF THE INVENTION

The principal object of the present invention is to provide a system for substantially instantaneously supplying hot water to the end user upon activation of a faucet.

Another object of the present invention is to provide a substantially instantaneous hot water system which may be readily secured inside a wall or otherwise hidden from view.

It is a further object of the present invention to provide a water tank which maintains separation of hot water in the tank from incoming cold water.

It is still a further object of the present invention to provide a water tank which is energy efficient.

It is still a further object of the present invention to provide a water tank which is inexpensive to manufacture.

It is still a further object of the present invention to provide substantially instantaneous hot water to a faucet to mitigate fluctuations in water temperature to the end user.

To accomplish these and other objects, the present invention is a system including a supplemental hot water reservoir, a controller monitoring the temperature in the piping, wherein, upon activation of the faucet, water from the supplemental hot water reservoir, the main hot water pipes, and cold water pipes are appropriately mixed to achieve the desired temperature.

These and other objects and features of the present invention will be better understood and appreciated from the following detailed description shown in the accompanying drawings in which:

DETAILED DESCRIPTION OF THE INVENTION

Figure 1:
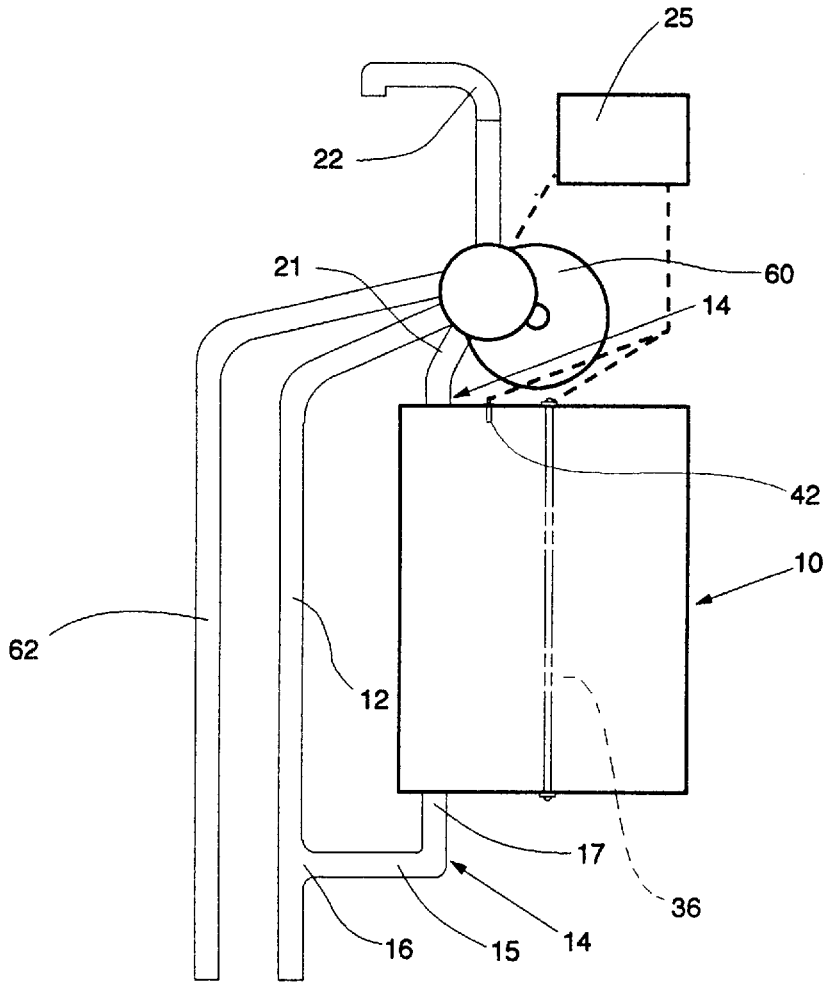
FIG. 1 is a schematic diagram of the present invention.

The present invention, best illustrated in FIG. 1, generally includes a supplemental hot water reservoir tank 10 secured in fluid communication to a main hot water line 12 at a location proximal to the outlet faucet 22 by supplemental piping 14. The supplemental piping 14 itself comprises a supplemental inlet line 15 and a supplemental outlet line 18. The supplemental inlet line 15 is attached to the main hot water line 12 at one end 16 and to the tank 10 at the other end 17. The supplemental outlet line 18 is secured at one end 20 to the tank 10 and in fluid communication with the faucet 22 at its other end 21. In addition, a controller 25 is connected between the tank 10 and an area proximal to the distal end 21 of the supplemental outlet line 18.

Figure 2:
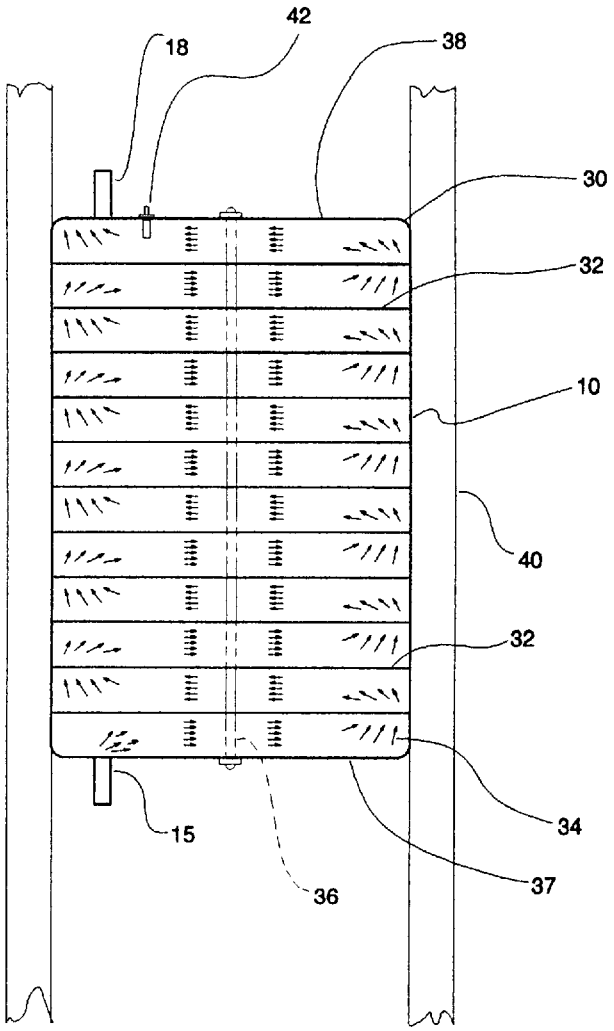
FIG. 2 is a front, cross-section elevational view of the supplemental hot water reservoir of the present invention.
Figure 3:
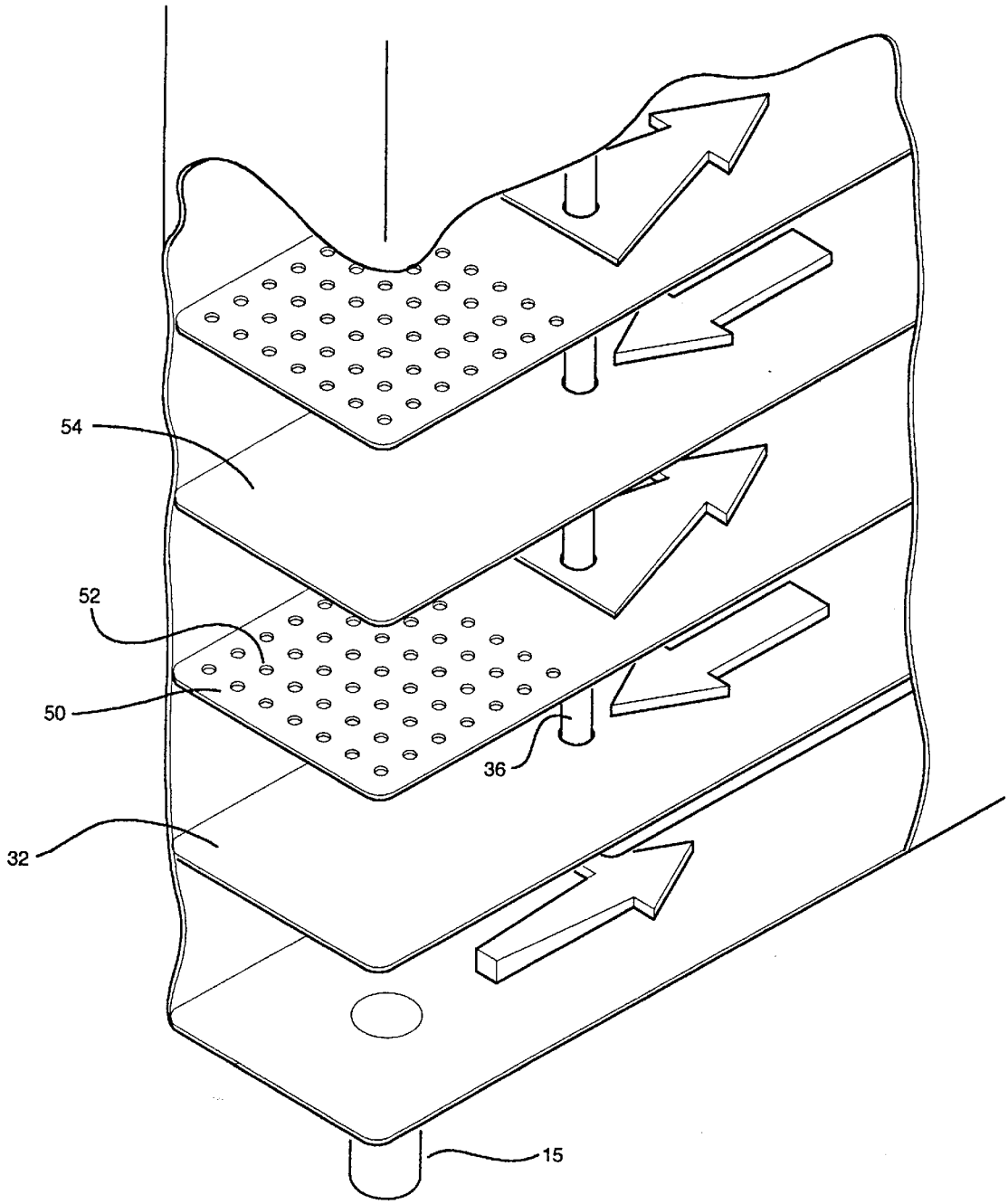
FIG. 3 is a detailed cut away of the reservoir of FIG. 2.

A detailed view of the tank 10 is best seen in FIGS. 2 and 3. The heating tank preferably has a capacity of less than 3 gallons, although larger capacity is possible. Typically, however, the capacity of the tank 10 is dependent on the volume of the main hot water line 12. The tank 10 has a generally rectangular shaped housing 30 including a plurality of dividers 32 in parallel arrangement. Consecutive dividers 32 form flow channels 34 therebetween. A heating element 36 extends from the bottom wall 37 of the tank 10 to the top wall 38. As illustrated, the heating element 36 has an exposed area within each channel 34.

The tank housing 30 and the dividers 32 can be manufactured by any number of methods well-known in the art. For example, they can be injection molded in two halves. The two halves are then sealed together after the heating element 36 is secured in position. The polymer used to form the housing 30 and dividers 32 must be suitable to endure repeated temperate cycling and constant exposure to water.

The dividers 32 may also be formed of non-corrosive metal. One method of manufacture is to stamp the dividers 32 from a sheet or strip of non-corrosive metal thereby forming dividers 32 separated by connecting members (not shown). The dividers 32 and the connecting members are then bent at alternating 90° angles to one another to form a serpentine pattern. The heating element 36 is next passed through the dividers 32. Then, after top and bottom tank plates with inlet and outlet lines are properly positioned, fiber glass or some other appropriate material is wrapped around the whole assembly to form the sealed housing 30.

The tank 10 may be secured within a wall by any number of well-known means, preferably between two wall studs 40. To facilitate securing the tank 10 to the studs 40, the housing 30 may be formed in two parts—one piece shaped like a rectangular pan and the other a flat sheet. The heating element 36 and the dividers 32 are positioned inside the pan and the flat sheet is secured on top and sealed. The flat sheet includes a border to accommodate nails or screws to attach the tank 10 to the wall studs 40.

While the illustration shows the tank 10 oriented with the supplemental inlet line 15 entering the tank 10 along the bottom wall 37 and the supplemental outlet line 18 extending outwardly from the tank top wall 38, other arrangements are possible. When the reverse arrangement is used, the water flow direction, as indicated by the arrows, would be reversed as well. Another variation would be to form vertical flow channels. In such an arrangement, the orientation of the heating element 36 would be changed accordingly.

The tank 10 also includes a temperature sensor 42, which is shown in FIG. 2, for measuring the water temperature. The sensor 42 is directly connected to the controller 25.

A detailed view of the interior of the tank 10 is shown in FIG. 3. Each divider 32 has an end 50 with a plurality of apertures 52 to permit water or other fluid to pass through. The arrangement and pattern of the apertures 52 can take any form, although circular holes are shown in FIG. 3. The other end 54 of each level divider 32 is continuous—having no apertures. The dividers 32 are arranged such that the ends in facing relationship alternate between an end 50 with apertures 52 and an end 54 without any such holes. This arrangement forces water through the tank 10 back and forth in a transverse manner as the water passes through each channel. This furter ensures both that the water in the tank 10 reaches the temperature of the heating element 36 before exiting and that the cold water entering the tank 10 through the supplemental inlet line 15 does not mix with the hot water leaving the tank 10.

In another embodiment, the aperture 52 can extend the length of the dividers 32 to form either a series of holes or slots. In such an arrangement, the water flow path is vertical, not serpentine, and minimizing of the exiting hot water and the entering cold water is accomplished in part by having narrow holes or slots to slow the upward flow of the water through the dividers 32.

The controller 25 monitors the water temperature by means of the temperature sensor 42 and also controls the electronics which regulate the power supplied to the heating element 36. The same controller 25 can control the position of the servo valve 60 based on the desired and sensed temperatures as will be discussed below. Generally, an 8-bit processor with memory and several input and output channels should suffice.

Figure 5:
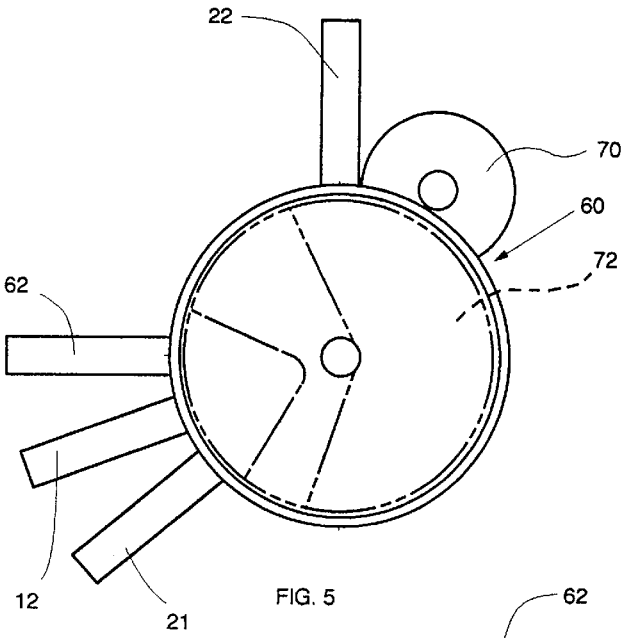
FIG. 5 shows the servo valve of the invention of FIG. 1 in the off position.
Figure 6:
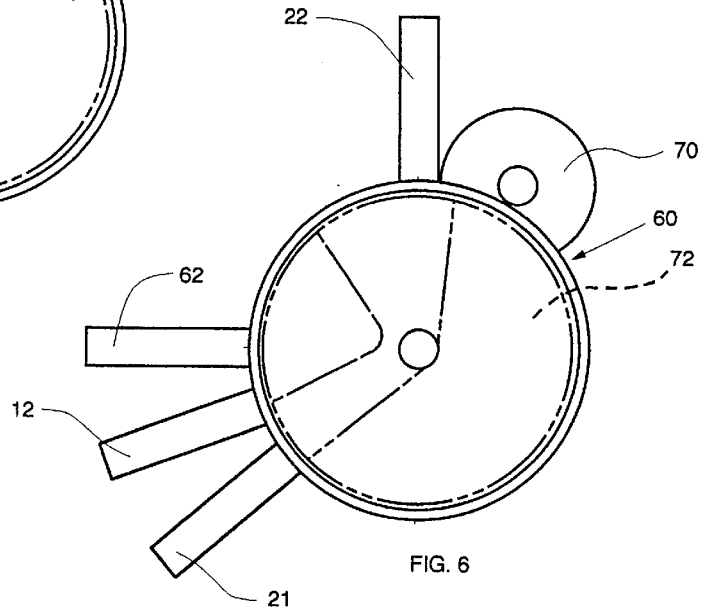
FIG. 6 shows the servo valve of the invention of FIG. 1 in a first open.
Figure 7:
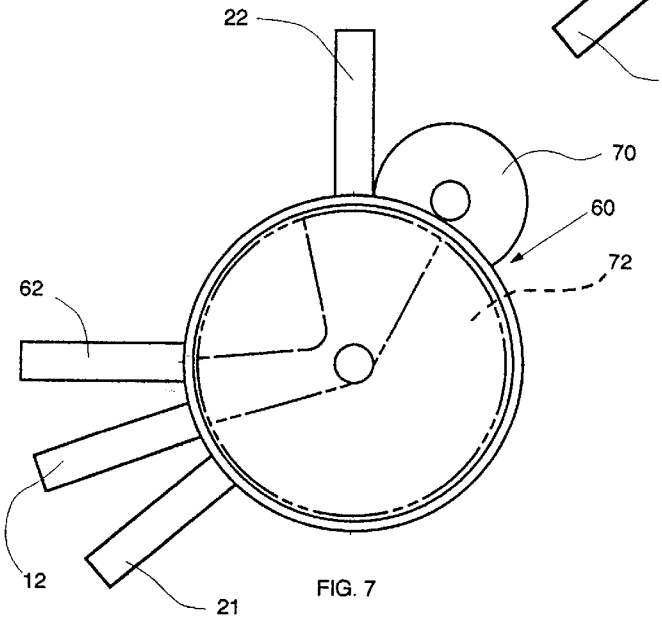
FIG. 7 shows the servo valve of the invention of FIG. 1 in a second open position.
Figure 8:
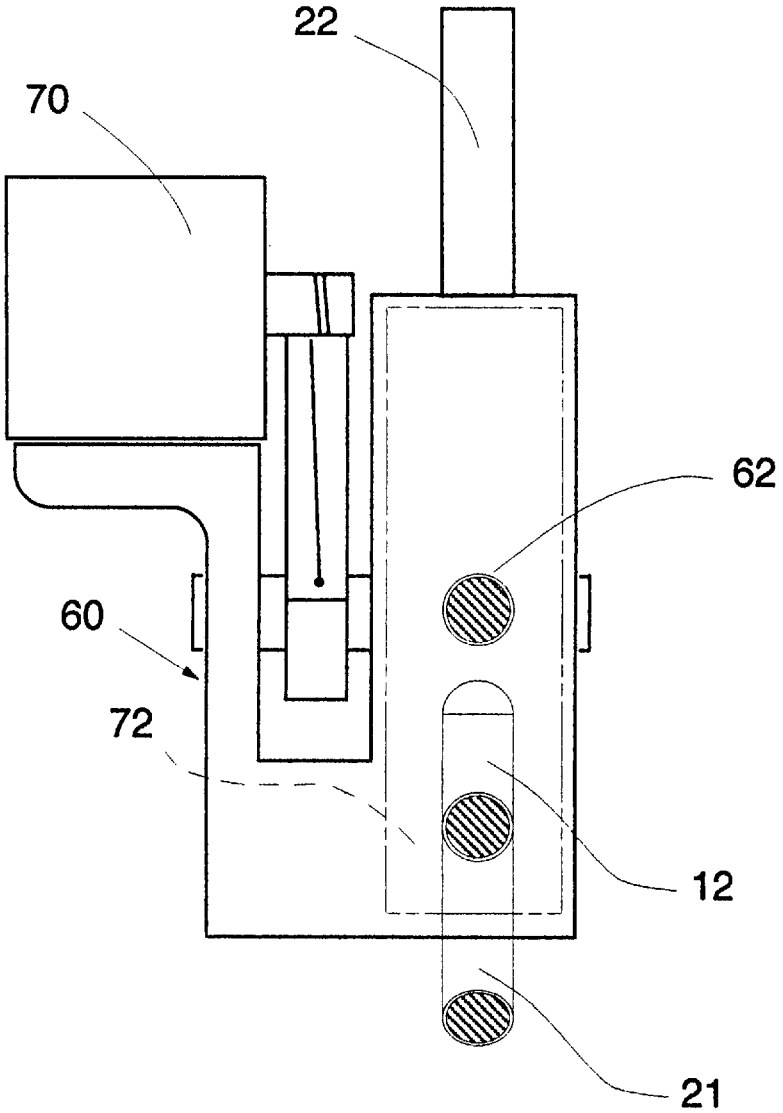
FIG. 8 shows a plain view of the motor housing of the servo valve.

The operation of the system is fairly straight forward. In the embodiment described herein, the desired temperature can be precisely set by means of the servo valve 60 or a similar unit along with the controller 25. The controller 25 reads the temperature of the water in the tank 10, the temperature of the main cold water line 62, and the temperature of the standing water in the main hot water line 12. Because the goal of the system is to flush the standing water from the main hot water line 12, the controller 25 determines whether to mix the standing water with water from the cold water line 62 or the supplemental hot water tank 10. Again, this determination as well as the calculation of percentage of the amount of water to be released from the selected lines directly depends on the desired temperature. In this arrangement, the controller 25 adjusts the servo valve 60. In FIG. 5, the mixer 72 of the servo valve 60 is shown in the off position. Here the openings to the valve 60 are not in communication with any of the lines 12, 21, or 62. Depending on the desired water temperature and the temperature in the lines and supplemental tank 10, the motor 70 of the valve rotates the mixer 72 into align so that the water either flows from the tank end 21 and the hot water line 12 (FIG. 6) or the hot water line 12 and the cold water line 62 (FIG. 7).

Figure 4:
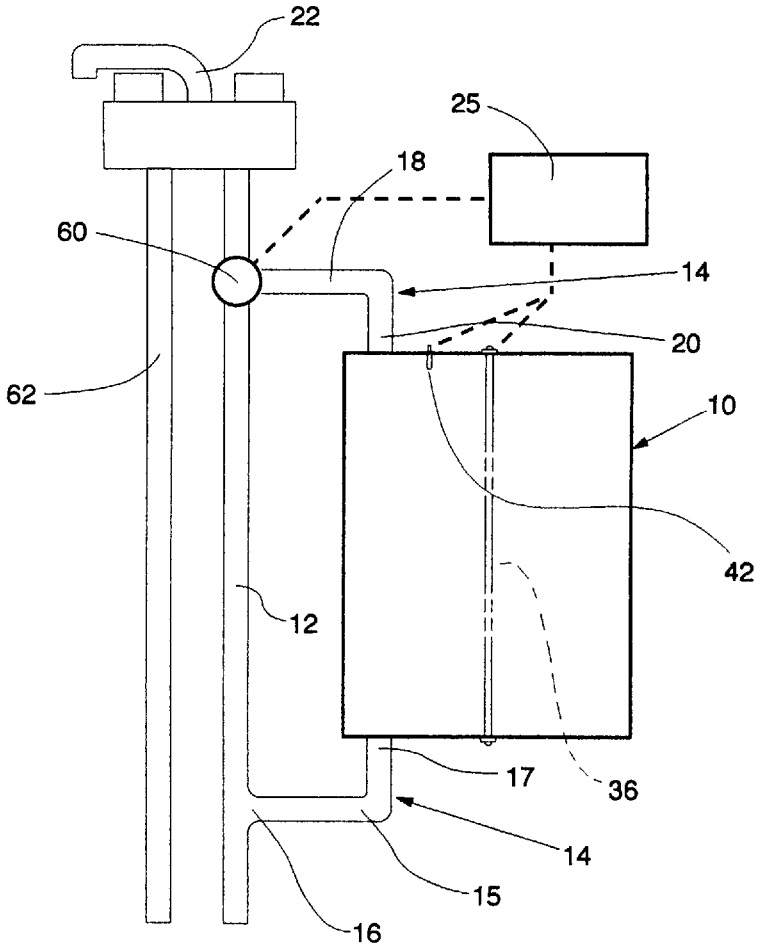
FIG. 4 is a schematic diagram of a second embodiment.

In another arrangement shown in FIG. 4, the desired temperature can be set by the user as the user turns the hot and cold water dials on a conventional faucet. As shown, the servo valve 60, is connected to the supplemental outlet line 18, and the main hot water line 12, and maintains a constant outlet temperature while simultaneously flushing out the standing water in the hot water line 12. As the water in line 12 stabilizes the controller 25 limits the amount of water released from the tank 10.

Yet another arrangement would be to program the servo valve 60 with the temperature of the hot water in the supplemental tank 10. In this embodiment, the controller 25 is not needed, and the servo valve 60 calculates the appropriate amounts without having to read the supplemental tank 10 temperature. Still another variation would be to program the temperature of the water in the cold water line 62 in the servo valve 60. However, this option is not viable in climates where the water temperature in the cold water line 62 greatly fluctuates. As a definitional matter, the servo valve 60 and controller 25 maybe constructed as one unit. In fact, a stand alone servo valve 60 with a means for reading and calculating temperatures effectively has at least some controller features.

For purposes of this discussion, assume that the water in the main cold water line 62 is X degrees, the standing water in the main hot water line 12 is Y degrees, and the water being provided by the supplemental hot water tank 10 is Z degrees. Also assume that the desired water temperature is T degrees. If T is between X and Y, the controller 25 or servo valve 60, depending on the embodiment, releases water in the proper proportions from the cold water line 62 and the main hot water line 12 such that the desired temperature is reached. As the temperature of the water in the hot water line 12 increases, the amount of cold water is appropriately increased to maintain the desired temperature T. When the water in the hot water line 12 reaches the temperature of the water being provided by main hot water tank, the percentages of water being mixed remains constant.

On the other hand, if the desired temperature T is between temperatures Y and Z, then the controller 25 or servo valve 60 would mix water from hot water line 12 and the tank 10. Again, when the standing water in the hot water line 12 finishes passing through the faucet 22, water is no longer drawn from the supplemental hot water reservoir 10, and the system only uses water from the main cold and hot water lines 12 and 62.

The extent to which the water exiting the faucet 22 is not instantaneously at the desired temperature is a direct result of the temperature and amount of standing water in the supplemental outlet line 18 and faucet 22. Generally, however, the delay should not be more than a few seconds.

Various changes and modifications and equivalents of the embodiments described above and shown in the drawings may be made within the scope of this invention. Thus, it is intended that all matters contained in the above description or shown in the accompanying drawings are presented by way of example only and are intended to be interpreted in an illustrative and not limiting sense.

I claim:

1. A system having a main hot water line with water at a first temperature and a main cold water line with water at a second temperature for providing water at a desired temperature substantially instantaneously to a faucet, comprising:

a separate supplemental hot water tank disposed in parallel to said main hot water line receiving water through a first end and in fluid communication with the faucet at a second end, said supplemental hot water tank providing water at a third temperature; and a valve positioned between said faucet and said supplemental hot water tank, said main cold water line, and said hot water line for releasing the water from said main hot water line, and one of said main cold water line or said supplemental tank in proportions such that the water exiting the faucet is at the desired temperature.

2. The system as set forth in claim 1, wherein said tank is secured in a wall.

3. The system as set forth in claim 1, further including a controller having supplemental hot water tank temperature monitoring and controlling means and a means for releasing water responsive to the temperature sensed by the supplemental hot water tank temperature monitoring means from said main hot water line, said main cold water line, and said supplemental tank.

4. The system as set forth in claim 3, wherein said means for releasing is a servo valve.

5. The system as set forth in claim 1, wherein said tank comprises:

a housing a plurality of dividers wherein each of said dividers has a first end with apertures and a second continuous end, said dividers arranged in parallel alignment with a said first end of a divider in facing alignment with said second end of a consecutive divider; and a heating element extending the height of said housing and passing through each of said of dividers.

* * * * *